US006311956B1

(12) United States Patent
Erwin

(10) Patent No.: US 6,311,956 B1
(45) **Date of Patent: *Nov. 6, 2001**

(54) HOLLOW SPINDLE WITH RECTANGULAR CROSS-SECTION

(75) Inventor: Ronald D. Erwin, Fayetteville, GA (US)

(73) Assignee: Erwin Industries, Inc., Peachtree City, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/459,163

(22) Filed: Dec. 10, 1999

Related U.S. Application Data

(63) Continuation-in-part of application No. 29/106,385, filed on Jun. 15, 1999, now Pat. No. Des. 420,152.
(60) Provisional application No. 60/144,845, filed on Jul. 21, 1999.

(51) Int. Cl.[7] ..... E04H 17/14
(52) U.S. Cl. ..... 256/59; 256/19; 256/65
(58) Field of Search ..... 256/59, 19, 65, 256/66, DIG. 5; D25/126

(56) References Cited

U.S. PATENT DOCUMENTS

| | | | | |
|---|---|---|---|---|
| D. 373,833 | * | 9/1996 | Lapp, Jr. | D25/126 |
| D. 420,152 | * | 2/2000 | Erwin | D25/126 |
| 4,027,855 | * | 6/1977 | Lauzier | 256/65 X |
| 4,035,978 | * | 7/1977 | Bajorek et al. | 256/65 |
| 5,149,060 | * | 9/1992 | Boes | 256/DIG. 5 |
| 5,626,331 | * | 5/1997 | Erwin | 256/59 |
| 5,876,021 | * | 3/1999 | Spence et al. | 256/19 |
| 6,017,019 | * | 1/2000 | Erwin | 256/65 |
| 6,039,307 | * | 3/2000 | De Zen | 256/19 |
| 6,126,148 | * | 10/2000 | Lesenskyj | 256/65 |

* cited by examiner

*Primary Examiner*—Lynne H. Browne
*Assistant Examiner*—David E. Bochna
(74) *Attorney, Agent, or Firm*—Gardner Groff Mehrman & Josephic, p.c.

(57) ABSTRACT

A hollow plastic spindle for use in a fence, railing or decking is elongate and molded from thin-walled plastic. The spindle has first and second ends opposite each other and four non-planar sides extending between the first and second ends. The non-planar sides are provided such that at any cross-sectional view taken through the spindle between its ends and perpendicular to an axis of elongation, the cross-section of the spindle is rectangular or square. This improves the bending strength of a hollow spindle, while allowing the spindle to retain the general appearance of a turned element.

5 Claims, 2 Drawing Sheets

HOLLOW SPINDLE WITH RECTANGULAR CROSS-SECTION

CROSS-REFERENCE TO RELATED APPLICATIONS

The present application is a continuation-in-part of U.S. design patent application Ser. No. 29/106,385 filed on Jun. 15, 1999 now U.S. Pat. No. D,420,152 and claims priority in U.S. provisional patent application Ser. No. 60/144,845 filed on Jul. 21, 1999.

TECHNICAL FIELD

The present invention is directed to decking and fencing products, and in particular to spindles and balusters for decking and fencing.

BACKGROUND OF THE INVENTION

Outdoor decks and fences are extremely popular in residential home construction. Homes and apartments, as well as a variety of other buildings, often incorporate exterior decks and fences into their design. Additionally, decks and fences are commonly added onto existing structures and landscapes. These decks and fences provide convenient spaces for a variety of outdoor activities, including cookouts, dining and sunbathing, as well as other leisure activities. Moreover, decks typically are provided with a railing or perimeter fence to keep people from falling over the edge of the deck.

Wood products have traditionally been the primary source of materials for use in decking construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of timber resources, wood products are becoming increasingly expensive. There is, therefore, a substantial need for long lasting substitute construction materials that can lessen the need to harvest timber resources.

One potential approach to addressing the above need is to provide substitute decking and fencing products made of plastic, rather than wood. However, because the deck and fencing products must be capable of sustaining certain loads, the replacement products need to be stable and rigid. The material should also be capable of economical manufacture, and be relatively inexpensive. It also needs to be easily fabricated and used in the field.

Many traditional spindles have a turned middle section, that is to say that they have a circular cross-section. This is a very popular design. Such traditional wooden turn spindles are typically made on a wood lathe wherein a roughly square blank is turned into a round spindle. To replace this product with a plastic substitute spindle presents something of a challenge in providing sufficient strength. An example of a good, strong substitute plastic spindle is shown in U.S. Pat. No. 5,626,331 of Erwin. A reason that it can be problematical to replace a round, hollow wooden spindle with simply a round plastic spindle is that the round, hollow plastic spindle does not bear bending loads very well.

Accordingly, it can be seen that a need yet remains for a plastic spindle which has the appearance of a turned spindle, but which exhibits increased strength to resist bending. It is to the provision of such a spindle that the present invention is primarily directed.

SUMMARY OF THE INVENTION

Briefly described, in a preferred form the present invention comprises a hollow spindle for use in a fence, railing, decking, or the like. The spindle is hollow and elongate and molded from plastic. The spindle has first and second ends opposite each other and four (4) non-planar (from top to bottom) sides extending between the first and second ends.

Preferably, the non-planar sides are provided such that at any cross-sectional view taken through the spindle between the ends (perpendicular to an axis of elongation), the cross-section of the spindle is rectangular. Most preferably, the rectangular cross-section is a square cross-section.

Preferably, edges are formed at the junctures of the four (4) non-planar sides and these edges are curvilinear.

The present invention allows the hollow plastic spindle to have a turned-like appearance, while providing excellent strength. (It is noted that the spindle's appearance is much like, but not exactly like, a turned spindle.) This arrangement provides two pairs of generally parallel sides, providing excellent strength. This is so because the width of the sides can be arranged to be parallel and perpendicular to the direction of typical lateral forces. By comparison, a hollow round plastic spindle really doesn't have sides that can be oriented parallel to the typical lateral force, resulting in a very weak structure. The present invention thus represents a substantial improvement over the known prior art.

BRIEF DESCRIPTION OF THE DRAWING FIGURES

DETAILED DESCRIPTION OF THE PREFERRED EMBODIMENTS

Figure 1:
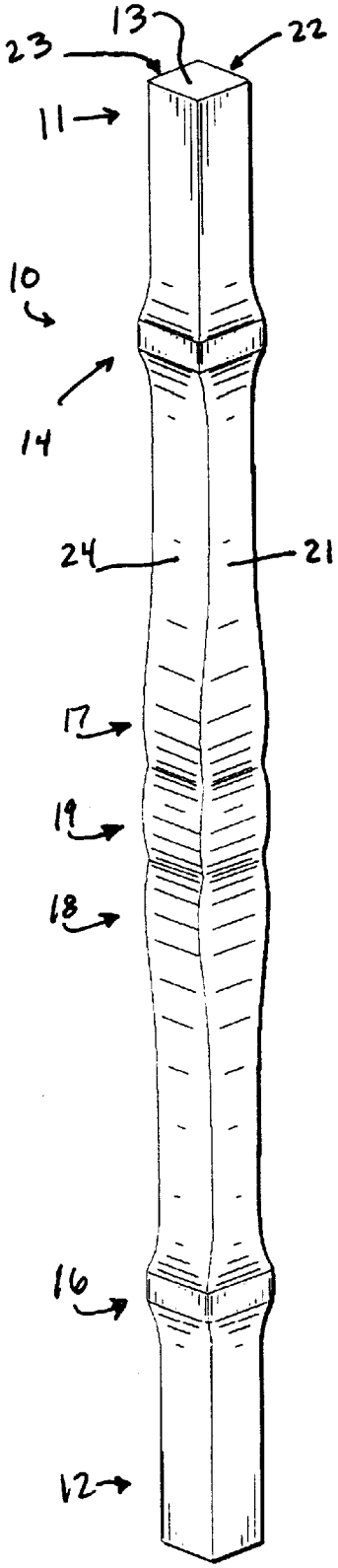
FIG. 1 is a perspective illustration of a spindle according to a preferred form of the invention.

Referring now in detail to the drawing figures, wherein like reference numerals represent like parts throughout the several views, FIGS. 1–6 show a hollow spindle 10 according to a preferred form of the invention. The hollow spindle 10 is elongate with first and second ends 11 and 12. The ends 11 and 12 are closed, as by end panel 13.

In the exemplary embodiment illustrated in FIGS. 1–6, the spindle 10 preferably includes bulbous sections or sections with enlarged transverse dimensions relative to the ends 11 and 12. For example, a first bulbous section 14 is positioned adjacent end 11 and a second bulbous section 16 is located adjacent end 12. After the bulbous sections 14 and 16, the spindle 10 necks down slightly before rising in transverse dimension to another pair of bulbous sections 17 and 18, which together straddle a middle bulbous section 19. Overall, the spindle has the general appearance of a turned spindle, although not quite exactly. In this regard, it is pointed out that the spindle has 4 facets or faces 21–24, comprised of two pairs of parallel and spaced apart faces, such as pair 21 and 23 and pair 22 and 24. Facet 21 is "parallel" to facet 23, while facet 22 is "parallel" to facet 24. It is pointed out that the facets are not, in the strictest mathematical sense, parallel inasmuch as they are not planar elements. However, at all points along the length of the spindle 10, the spindle 10 has a rectangular cross-section. This can best be seen in FIG. 4–FIG. 6. Thus, it is convenient to describe the facets as being "parallel" to each opposite facet.

Preferably, the spindle 10 is blow-molded out of any suitable material, such as PVC or another sturdy, weather-resistant plastic. Preferably, the wall thickness is at least 0.080" and more preferably is around 0.1". The spindle can be made of thicker walls, but at additional cost due to the increased amount of material consumed in fabrication. Indeed, it is by making the spindle having square cross-section (or as we will see later a rectangular cross-section) that a spindle can be provided with excellent bending strength while having thin walls (and low cost).

Figure 2:
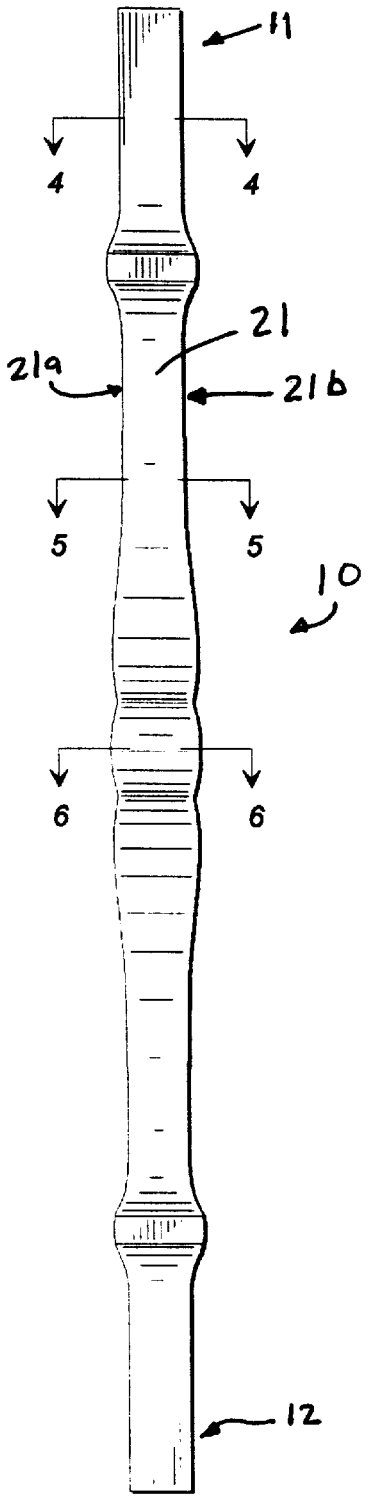
FIG. 2 is a front elevation view of the spindle of FIG. 1 (with rear, left, and right views being identical thereto).
Figure 3:
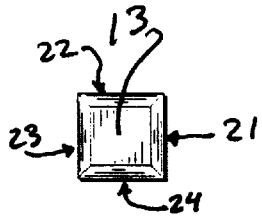
FIG. 3 is a top view of the spindle of FIG. 1 (with the bottom view being identical thereto).
Figure 4:
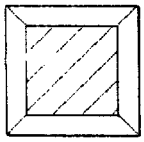
FIG. 4 is a sectional view of the spindle of FIG. 1 taken along view lines 4—4.
Figure 5:
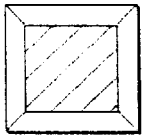
FIG. 5 is a sectional view of the spindle of FIG. 1 taken along view lines 5—5.
Figure 6:
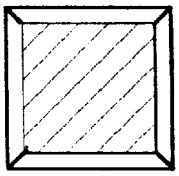
FIG. 6 is a sectional view of the spindle of FIG. 1 taken along view lines 6—6.

As seen in FIGS. 1 and 2, the facets each have two side edges, for example side edges 21*a* and 21*b* of FIG. 2. These side edges extend from the extreme end of the spindle 10 to an opposite extreme end. Preferably, the side edges have a curvilinear profile. The curvilinear profile gives the appearance of a turned spindle. Meanwhile, the four facets provide good strength similar to a square spindle.

Figure 7:
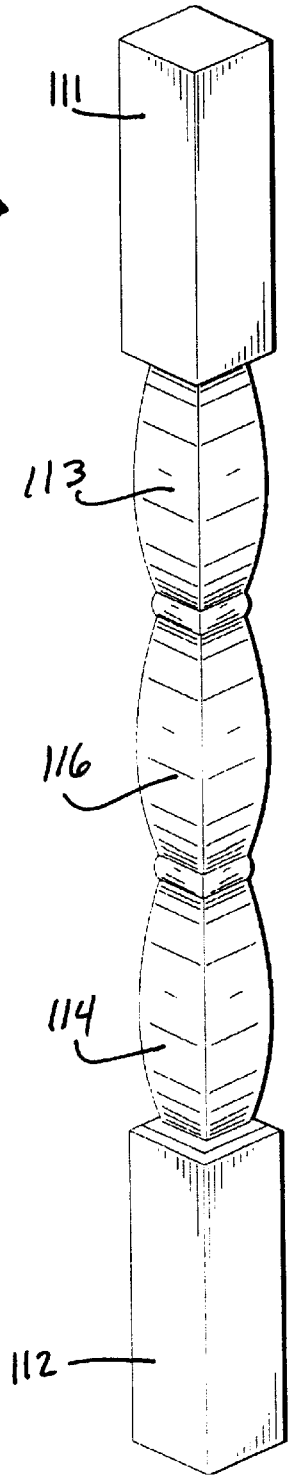
FIG. 7 is a perspective illustration of a spindle according to another preferred form of the invention.

FIG. 7 shows another preferred form of the invention, namely a spindle 110 having opposite ends 111 and 112. One notable difference between the embodiment of FIG. 7 and that just described above is that the ends 111 are at least as large as or larger than the intermediate section of the spindle between the ends 111 and 112. This adds to the illusion that the spindle 110 is turned. In the illustrative embodiment shown in FIG. 7, spindle 110 includes 3 bulbous section, namely outer bulbous sections 113 and 114 which straddle an intermediate or central bulbous section 116. Between the ends 111 and 112, the spindle 110 has a curvilinear overall appearance. The curvilinear overall appearance is achieved by the four facets of the spindle having curvilinear edges.

Figure 8:
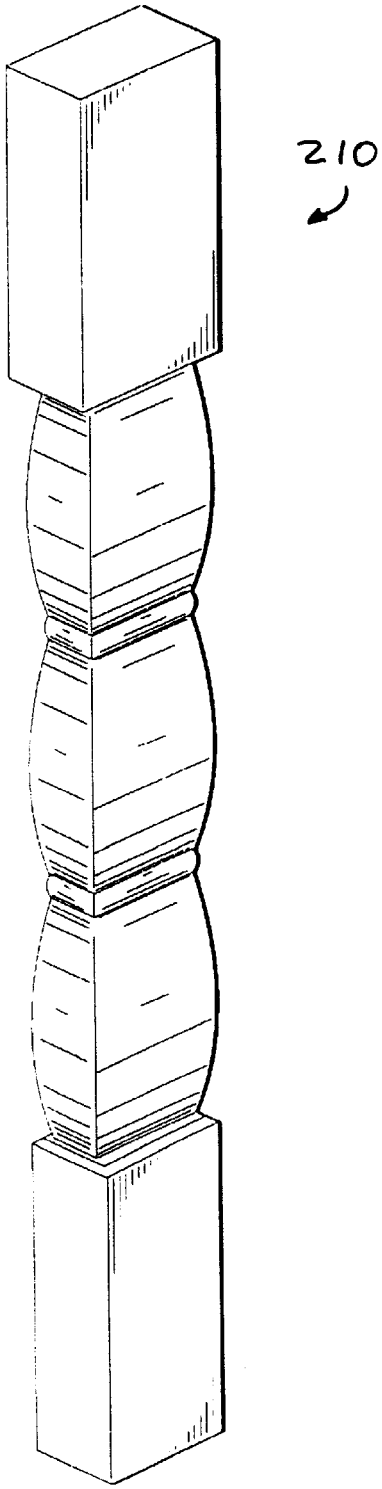
FIG. 8 is perspective illustration of another spindle according to another preferred form of the present invention.

FIG. 8 shows yet another exemplary embodiment. As shown in FIG. 8, a spindle 210 is provided which is rather similar to the spindle 110 of the second embodiment. However, here the spindle is made to have rectangular, not perfectly square, cross-sections all along its length. This improves the bending strength of the spindle 210 along the major axis of the rectangle. This advantage can be exploited by orienting the spindle 210 such that the major axis of the rectangular cross-section is parallel to the expected bending force. Simply put, one can arrange the spindles 210 in a fence or railing with the spindles being oriented so that the longer sides of the rectangular facets are perpendicular to the length of the fence or railing.

While the invention has been disclosed in preferred forms, those skilled in the art will recognize that many modifications, additions, and deletions can be made therein without departing from the spirit and scope of the invention as set forth in the following claims.

What is claimed is:

1. A spindle for use in a fence, railing, decking or the like, comprising:

an elongate, hollow, molded plastic member having first and second end sections opposite each other, said plastic member having an intermediate section with four (4) non-planar sides extending between said first and second end sections, wherein each of said four sides is not flat, wherein at all points along a longitudinal axis of said intermediate section, a cross-section of said plastic member perpendicular to said longitudinal axis is rectangular.

2. A spindle as claimed in claim 1 herein said rectangular cross-section is square.

3. A spindle as claimed in claim 1 wherein edges are formed at junctures between said four (4) non-planar sides and wherein said edges are curvilinear.

4. A spindle as claimed in claim 1 wherein at least one point along a longitudinal axis of said intermediate section has a cross-section with an area that is larger than a cross-section at another point along a longitudinal axis of said intermediate section.

5. A spindle as claimed in claim 1 wherein said first and second end sections each have four (4) planar sides.

* * * * *